United States Patent [19]

Murata et al.

[11] 4,113,375

[45] Sep. 12, 1978

[54] POWER REGULATING DEVICE FOR CONTROLLING EXPOSING MEANS AND FIXING MEANS IN ELECTROPHOTOGRAPHIC COPYING APPARATUS

[75] Inventors: Tomoji Murata, Toyokawa; Kenji Shibazaki, Aichi, both of Japan

[73] Assignee: Minolta Camera Kabushiki Kaisha, Japan

[21] Appl. No.: 740,725

[22] Filed: Nov. 10, 1976

[30] Foreign Application Priority Data

Nov. 13, 1975 [JP] Japan ..... 50-155035[U]

[51] Int. Cl.[2] ..... G03G 15/00

[52] U.S. Cl. ..... 355/14; 355/3 FU

[58] Field of Search ..... 355/3 DD, 3 FU, 14, 355/69; 219/216, 488, 492

[56] References Cited

U.S. PATENT DOCUMENTS

| | | | |
|---|---|---|---|
| 3,692,408 | 9/1972 | Nakamura | 355/69 |
| 3,790,747 | 2/1974 | Klausons et al. | 219/216 |
| 3,833,794 | 9/1974 | Moriyama | 219/492 X |
| 3,989,370 | 11/1976 | Mooney | 355/14 |

*Primary Examiner*—William M. Shoop

*Attorney, Agent, or Firm*—Wenderoth, Lind & Ponack

[57] ABSTRACT

The power regulator of the present disclosure is operated by a source of D.C. power for controlling the A.C. power to be supplied to an exposing device and to a fixing device. It comprises a first circuit for operating the exposing device, a second circuit for operating the fixing device, a switching circuit for alternately operating the first and second circuits and a third circuit for operating the fixing device independently of the operation of the switching circuit so that the fixing device may be warmed up by the operation of third circuit during the operation of the exposing device.

18 Claims, 5 Drawing Figures

FIG. 1
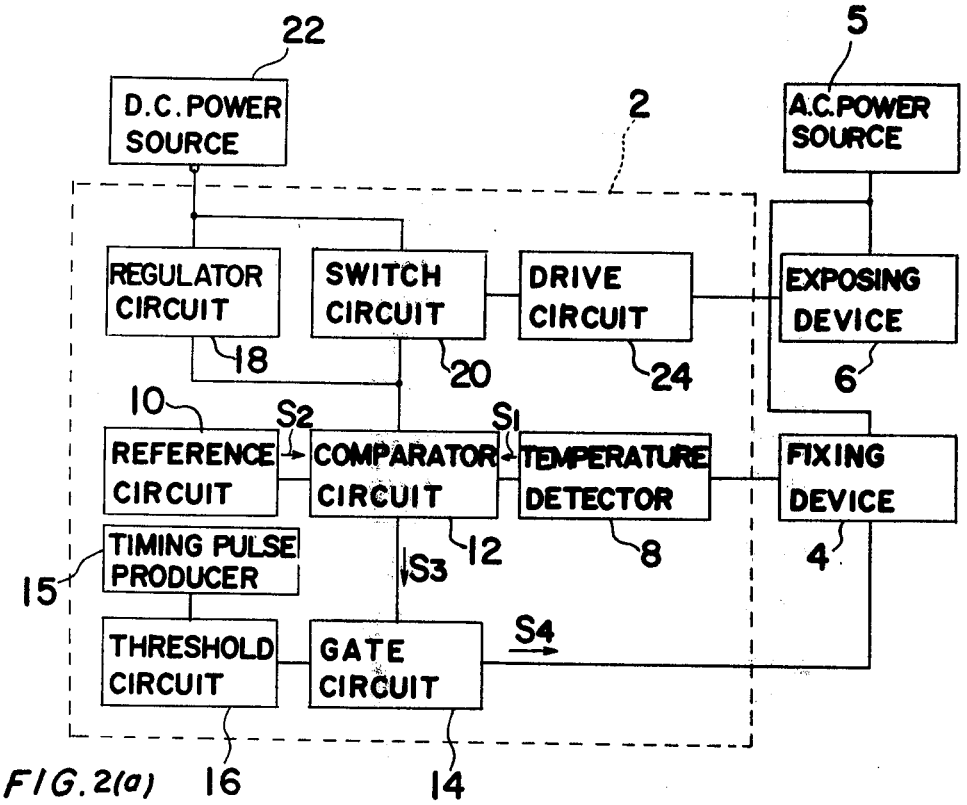
FIG. 2(a)
FIG. 2(b)
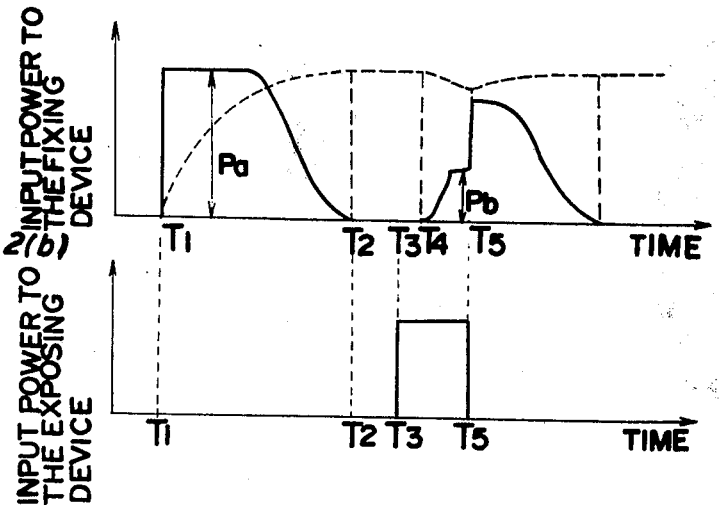

POWER REGULATING DEVICE FOR CONTROLLING EXPOSING MEANS AND FIXING MEANS IN ELECTROPHOTOGRAPHIC COPYING APPARATUS

The present invention relates to an electrophotographic copying apparatus and more particularly, to a power control device or power regulator for regulating the electrical power supplied to a heating device whereat a visible toner image transferred onto a transfer material is fixed thereto.

In an electrophotographic copying apparatus of a xerographic or similar system, light images of an original to be copied which is illuminated by an exposure lamp are directed onto a preliminarily charged photoreceptor surface to form thereon an electrostatic latent image of the original. This which is subsequently developed into a visible toner image by a developing device and is then transferred by a transfer device onto a copy material such as a copy paper sheet. The toner image thus transferred is further fixed onto the copy material through fusion by heat at a fixing device before the copy material is discharged out of the copying apparatus.

Usually, in the electrophotographic copying apparatus, the lamp in the exposing device and the heater in the fixing device consume a considerable amount of power, so that an enormous amount of power is necessary to have both of the devices operated at the same time. Then, it would be necessary to supply higher power than that normally available at the consumer's outlet from the electric power distribution center, to the places where this type of electrophotographic copying apparatus is furnished.

In order to overcome this trouble in the power supply, the electrohphotographic copying apparatus is usually provided with a power regulator which may alternately provide power to the exposing device or to the heating device or may predetermine the maximum power available for each of the exposing and heating devices to avoid exceeding the supplying power of the whole.

In one type of power regulating device for use in the conventional electrophotographic copying apparatus, it is arranged that the heating element of the fixing device and the lamp of the exposing device are actuated alternately so as to avoid operation of the fixing device and the exposing device at the same time. Therefore, the power consumption of the copying apparatus on the whole is thus averaged. More specifically, in the conventional copying apparatuses, the heating element of the fixing device is adapted to be turned off during energization of the exposure lamp and vice versa in a manner disclosed, for example, in U.S. Pat. No. 3,416,860, patented to S. Mihojevich et al.

However, in such a type of power regulating system, the heating element of the fixing device itself cools down during the operation of the exposure lamp, and each time the fixing device is to be operated, it takes some time before the heating element is warmed up again to a predetermined temperature, with a consequent reduction of the thermal efficiency of the fixing device.

Another type of power regulating system, disclosed in U.S. Pat. No. 3,692,408, patented to Kitamaro Nakamura, includes a rectifier for rectifying A.C. power to be supplied to the fixing device and exposing device, so as to provide respective half cycles of the A.C. power source to the exposing device and the fixing device. Hence, the maximum power available for the fixing device, as well as the exposing device is 50 percent of the full A.C. power. Therefore, the power supplied to the fixing device is not sufficient for securely fixing the toner image onto the copy material.

Accordingly, the primary object of the present invention is to provide an improved type of power regulator for use in a fixing device of an electrophotographic copying apparatus which is capable of operating the fixing device in an optimum condition by providing some percentage of power to the heating element of the fixing device even during the operation of the exposure lamp for warming up the fixing device.

Another object of the present invention is to provide a power regulator of the above described type in which the maximum power available for the fixing device during the operation of the exposure lamp is variable to be regulated to a desirable value.

Still another object of the present invention is to provide a power regulator of the above described type in which the total current flowing through the electrophotographic copying apparatus is regulated to remain as small as possible.

A further object of the present invention is to provide a power regulator of the above described type in which the phase of electric power supplied to the fixing device is regulated between the minimum and the maximum advanced phase for improving the thermal efficiency of the fixing device, and also for averaging the power consumption of the copying apparatus as a whole.

A still further object of the present invention is to provide a power regulator of the above described type which is stable in functioning and simple in construction for incorporation into a copying apparatus at low cost.

The power regulator of the present invention is operated by a source of D.C. power for controlling the A.C. power supplied to the exposing device and to the fixing device. It comprises a first means for operating the exposing device upon receipt of D.C. power, a second means for operating the fixing device upon receipt of D.C. power, a switching means for alternately providing D.C. power to said first and second means and a third means for providing D.C. power to the second means independently of the operation of the switching means, so that the fixing device is warmed up by the operation of the third means during the operation of the exposing device.

When the main switch for the electrophotographic copying apparatus is turned on, the switching means simultaneously actuates the second means, so that the fixing device is warmed up to a certain temperature determined by a temperature regulator incorporated in the second means. During the warm up, the full power available is supplied to the fixing device.

When the original is placed on the platform, ready for starting the copying operation, a suitable switch provided on a control panel on the electrophotographic copying apparatus is manipulated to operate the switching means which operates the first means, so as to actuate the exposing device. The exposing device is supplied with, for example, approximately 70% of the full power supplied to the electrophotographic copying apparatus, which is enough for its operation. During the operation of the exposing device, the third means operates the fixing device, for example at about 30% of the full power at most, so that the temperature in the fixing device is maintained at or close to the desirable temperature determined by the temperature regulator.

It should be noted that the ratio of the power distributed to the exposing device to that supplied to the fixing device described, for example, 70% to 30% can be changed to any other ratio by changing a variable element in the third means.

After the images of the original have been projected onto the photoreceptor surface through the exposing device, the switching means is switched from the second means over to the first means, so that the fixing device is operated at full power, to maintain the temperature at the desirable temperature.

Since the second means is provided with a temperature regulator, said second means regulates the input power to the fixing device by an amount which is necessary to maintain the temperature therein at the desirable temperature. In other words, the second means does not always provide all the power available to the fixing device, but provides the necessary power when the fixing device is cooled down to a comparatively low temperature.

These and other objects and features of the present invention will become apparent from the following description taken in conjunction with a preferred embodiment thereof with reference to the accompanying drawings, wherein;

FIG. 1 is a block diagram of the power regulator of the present invention;

FIGS. 2(*a*) and 2(*b*) are graphs showing time relation of the input power supplied to the fixing device and the exposing device.

Figure 3:
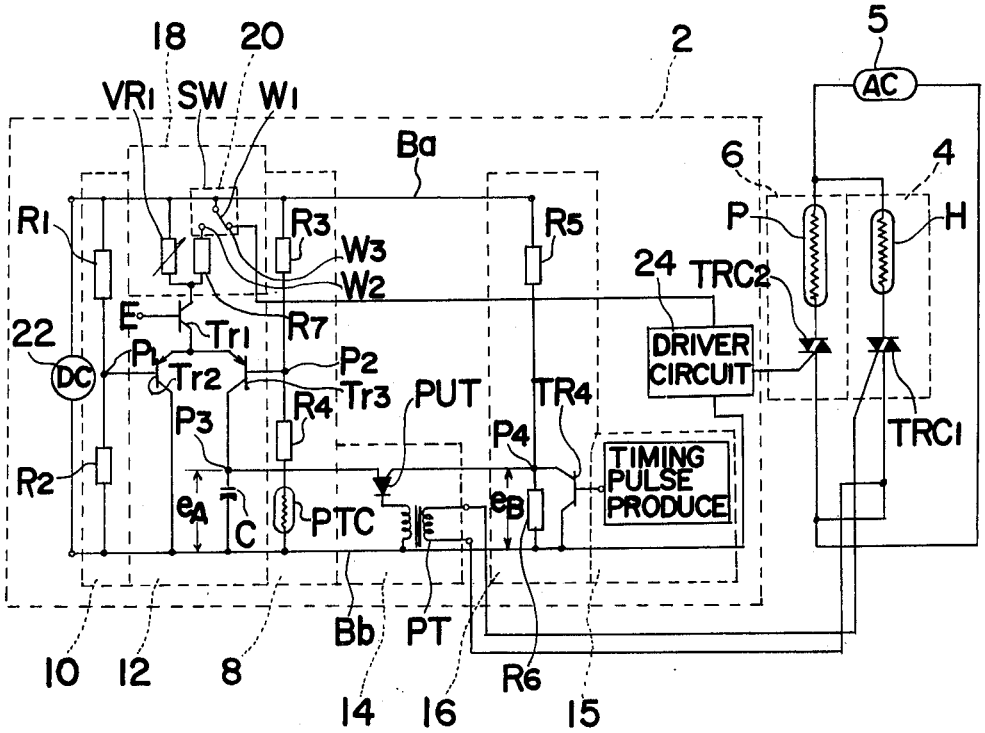
FIG. 3 is a complete circuit of the power regulator shown in FIG. 1.

Referring to FIG. 1, the power regulator 2 of the present invention, surrounded by a dotted line, is coupled to a fixing device 4 including a heating element mentioned later where a copy material having a toner image transferred thereon is heated for fixing the toner image thereon, and also to an exposing device 6 including an exposure lamp mentioned later where an original to be copied is illuminated for the formation of a latent image on the surface of a photoreceptor. The fixing device 4 and the exposing device 6 are operated, by an A.C. power source 5 upon receipt of a control signal from the power regulator 2. The power regulator 2 comprises a temperature detector 8 coupled to the fixing device 4 for producing a signal $S_1$ indicative of the temperature in the fixing device 4, a reference circuit 10 for producing a reference signal $S_2$ fixed at a predetermined level and a comparator circuit 12 for comparing the signal $S_1$ with the signal $S_2$ for producing a signal $S_3$ indicative of the difference between the signals $S_1$ and $S_2$. A gate circuit 14 is connected to the comparator circuit 12 for supplying a pulsating signal $S_4$ to the fixing device 4 upon receipt of the difference signal $S_3$. The timing for producing the pulsating signal $S_4$ is determined by a timing pulse producer 15 via a threshold circuit 16 connected to the gate circuit 14, so that the phase of the pulsating signal $S_4$ is shifted between minimum and maximum phases in each cycle, thus regulating the output power of the fixing device 4 between high and low states, the manner of which is described in detail later.

The regulator 2 of the present invention further comprises a regulator circuit 18 and switch circuit 20 which are connected in parallel to each other, and are connected at one end to the comparator circuit 12 and at the other end to a source of D.C. power 22. The switch circuit 20 is further connected to a drive circuit 24 which in turn connected to the exposing device 6. The current from the D.C. power source 22 is supplied partially, for example, 30% thereof, to the regulator circuit 18 and partially, for example, 70% thereof, to the switch circuit 20 when the switch circuit 20 is connected to the comparator circuit 18. The current which is supplied to the switch circuit 20 is alternately supplied to the drive circuit 24 and to the comparator circuit 12, whereas the current supplied to the regulator circuit 18 is supplied constantly to the comparator circuit 12. It should be noted that such percentages are variable with respect to change of a variable element such as variable resistor provided in the regulator circuit 18.

The function of the power regulator 2 is briefly explained hereinbelow in connection with FIGS. 2(*a*) and 2(*b*).

Upon turning on the main switch (not shown) for the electrophotographic copying apparatus, the switch circuit 20 connects the line from the D.C. power source 22 to the comparator circuit 12, so that comparator circuit 12 receiving currents from the regulator circuit 18 and the switching circuit 20 provides the signal $S_3$ having full power to the gate circuit 14. In the gate circuit 14, the signal $S_3$ is modulated into a pulse signal $S_4$ with the phase thereof shifted to indicate full power. The pulse signal $S_4$ provided to the fixing device 4 is applied to a triac in the fixing device 4 for providing full power from the A.C. power source 5 to the fixing device 4 as shown in FIG. 2(*a*) in the solid line at the time $T_1$. Therefore, the fixing device 4 which has been at a comparatively low temperature for use is rapidly heated up to a desirable temperature, as shown in the dotted line. As the temperature of the fixing device increases to reach the desirable temperature determined by the reference circuit 10, the power of the signal $S_3$ decreases from full power to zero power, as represented in FIG. 2(*a*) at the time $T_2$. Thereafter, the temperature may decrease to some degree, but the fixing device is reheated upon detection of a decrease in the temperature detector 8 to restore the desirable temperature.

Upon starting a copying operation of the electrophotographic copying apparatus, the switch circuit 20 which has been connecting the line from the D.C. power source 22 to the comparator circuit 12, now connects the line with the drive circuit 24, so that the signal generated therein is applied to a triac in an exposing device to provide some percentage of the full power, for example, 70% thereof from the A.C. power source 5, as represented in FIG. 2(*b*) at the time $T_3$. It should be noted that the exposing device is designed to operate properly at, for example, 70% of the full power from the A.C. power source 5. The rest of the A.C. power, which is 30% thereof in this example, is reserved for operating the fixing device 4 during the operation of the exposing device 6 which may last until time $T_5$. During the operation of the exposing device 6, the temperature of the fixing device 4 may decrease below the desirable temperature. In this case, the temperature detector 8 detects such a decrease and the comparator circuit 12 generates, at the time $T_4$, the signal $S_3$ from the current flowing through the regulator circuit 18.

Since the regulator circuit 18 allows 30% of the full power from the D.C. power source 22 to flow therethrough, the signal $S_3$ is restricted to produce at most 30% of the full power. Thus, the pulse signal $S_4$ is shifted at to indicate 30% of the full power at most. Therefore, at most 30% of the full power from the A.C. power source 5 is available for heating the fixing device during the operation of exposing device 6.

Although it is small in power, this A.C. power provided to the fixing device 4 during the operation of exposing device 6 helps to maintain the temperature of the fixing device in at or close to the desirable temperature.

As it will be understood to those skilled in the art, during the time interval between the time $T_2$ and $T_4$, the temperature in the fixing device is maintained at the predetermined temperature, and that reference characters P*a* and P*b* designate a maximum power available for the fixing device during off-state and on-state of the exposing device, respectively.

After the images of the original are projected onto the photoreceptor surface through the exposing device 6, the switch circuit 20 switches the connection of the line from the drive circuit 24 to the comparator circuit 12, at the time $T_5$. If, at the time $T_5$, the temeprature of the fixing device 4 were still below the desirable temeprature, then the current flowing through the switch circuit 20, in addition to the current flowing through the regulator circuit 18 would cause on the comparator circuit 12 to generate a signal $S_3$ having a higher power to bring the temperature of the fixing device 4 in the desirable temperature. Since the fixing device 4 is preheated during the operation of the exposing device, the full A.C. power is not necessary to heat up the fixing device to the desirable temperature. As the temeprature in the fixing device increases to the desirable temperature, the regulator 2 regulates the input A.C. power to the fixing device to decrease down to zero-power.

Referring to FIG. 3, there is shown a complete circuit for the power regulator 2 together with heating element or heater H provided in the fixing device 4 and an exposure lamp P provided in the exposing device 6. The heating element H is coupled to a source of A.C. power 5 through a triac $TRC_1$, while the exposure lamp P is connected to the same A.C. power source 5 through a triac $TRC_2$.

The reference circuit 10 comprises resistors $R_1$ and $R_2$ connected in series to each other and are inserted between a positive lead line B*a* and negative lead line B*b* leading to the D.C. power source 22 for producing a predetermined reference voltage across the resistor $R_2$ at the junction designated by the reference character $P_1$. The temperature detector 8 comprises resistors $R_3$ and $R_4$ and positive temperature coefficient semiconductor PTC (hereinbelow referred to simply as PTC) which are connected in series and are inserted between the positive and negative lead lines B*a* and B*b*. The PTC is positioned adjacent to the heating element H for receiving the heat in the fixing device 4 whereupon the resistance of the PTC increases in relation to the temperature rise. Accordingly, the signal $S_1$ indicative of the temperature in the fixing device 4 is obtained at a junction $P_2$ positioned between the resistors $R_3$ and $R_4$. The switch circuit 20 comprises a switch SW having an arm $W_1$ which may be connected to either a terminal $W_2$ or to a terminal $W_3$. The terminal $W_3$ is connected to the gate of the $TRC_2$ through a driver circuit 24 which produces a pulsating signal when the arm $W_1$ of the switch SW is connected to the terminal $W_3$ for lighting the lamp P, and the terminal $W_2$ is connected to the regulator circuit 18.

The regulator circuit 18 comprises a variable resistor $VR_1$ connected to the positive lead line B*a* and a resistor $R_7$ connected to the terminal $W_2$ which are in turn connected to the emitter of a transistor $Tr_1$ in the comparator circuit 12. The base of the transistor $Tr_1$ is supplied with a constant voltage E capable of causing a constant current to flow therethrough. The comparator circuit 12 further comprises transistors $Tr_2$ and $Tr_3$ having their emitters connected to the collector of the transistor $Tr_1$. The base of the transistor $Tr_2$ is connected to the junction $P_1$ while the base of the transistor $Tr_3$ is connected to the junction $P_2$. The collector of the transistor $Tr_2$ is connected to the negative lead line B*b* directly, while the collector of the transistor $Tr_3$ is connected to the negative lead line B*b* through a capacitor C. The comparator circuit 12 compares the voltage difference between the voltages at the junctions $P_1$ and $P_2$ and allows a current to flow through the transistor $Tr_3$ when the voltage level at the junction $P_2$ is lower than that at the junction $P_1$. The amount of the current flowing through the transistor $Tr_3$ is in relation to this difference. It should be noted that the current flowing through the transistor $Tr_3$ is larger or a step higher when the switch SW has its arm $W_1$ connected to the terminal $W_2$ than when the same connected to the terminal $W_3$. These currents are fed to the capacitor C for producing at a junction $P_3$ the signal $S_3$ which is the charged voltage in the capacitor C. The signal $S_3$ is then applied to the gate circuit 14 which comprises a programable unijunction transistor PUT (hereinbelow referred to as PUT) having the anode thereof connected to the junction $P_3$ and the cathode thereof connected to one end of a primary winding of a pulse transformer PT. The other end of said primary winding is connected to the negative lead line B*b*. The secondary winding of the pulse transformer PT is connected to the gate terminal of the triac $TRC_1$. Connected to the gate circuit 14 at the gate of the PUT is the threshold circuit 16 comprising a resistors $R_5$ and $R_6$ connected in series to each other and inserted between the the positive and negative lead lines B*a* and B*b* and a transistor $Tr_4$ having the collector thereof connected to a junction $P_4$ positioned between the resistors $R_5$ and $R_6$. It should be noted that the junction $P_4$ is further connected to the gate of the PUT. The base of the transistor $Tr_4$ is connected to a timing pulse producer 15 which produces a pulsating signal at the moment when the wave form of the A.C. power in the A.C. power source 5 crosses the zero-level.

When starting the operation of the electrophotographic copying apparatus, the arm $W_1$ of the switch SW is turned by the main switch means (not shown) to the terminal $W_2$ for providing D.C. power from the source 22 to the comparator circuit 12. In the meantime, the D.C. power from the power source 22 is also fed, through the variable resistor $VR_1$ of the regulator circuit 18 and the resistor 7 and the transistor $Tr_1$ to the comparator circuit 12, wherein a current flows through the transistor $Tr_3$. The amount of such current is in relation to the voltage difference between the junctions $P_1$ and $P_2$. When the voltage level at the junction $P_2$ is lower than that of the junction $P_1$, i.e., when the resistance of the PTC is substantially low due to low temperature in the heating element H, the current flows through the transistor $Tr_3$. On the other ahnd, in cases where the voltage level at the junction $P_2$ is larger or equal to that of the junction $P_1$, no current will flow through the transistor $Tr_3$. During the current flowing through the transistor $Tr_3$, the capacitor C is charged at a rate related to the amount of the current, so that a voltage level $e_A$ at the junction $P_3$ is increased. When the voltage level $e_A$ reaches the threshold voltage $e_B$ determined by the resistors $R_5$ and $R_6$, the voltage in the capacitor C is discharged through the PUT between the anode and the cathode thereof. This discharge current generates a pulse in the pulse transformer PT. The timing for producing this pulse is controlled by the timing pulse producer 15 which is described hereinbelow in connection with FIG. 4.

Figure 4:
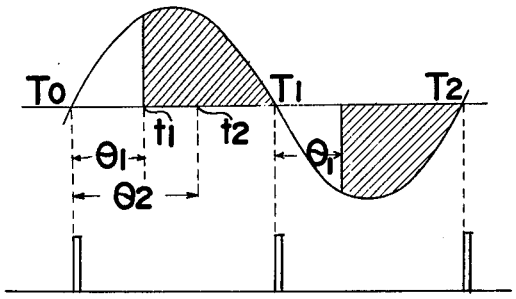
FIG. 4 is a waveform of the A.C. power to be supplied to the heating element of the pulsating current generated in the timing producing circuit.

Referring to FIG. 4, a sine wave shows the waveform of the A.C. power applied across the heating element H, while a pulsating wave shows the waveform of the signal generated from the timing pulse producer 15. As is apparent from FIG. 4, the moment for producing each pulse of the pulsating wave corresponds with the moment when the A.C. power is at its zero-level points, namely, zero-cross times $To$, $T_1$ and $T_2$. Such pulses generated in the timing pulse producer 15 are applied to the base of the transistor $Tr_4$, thereby totally discharging the capacitor C at the zero-cross moments through the transistor $Tr_4$. Thus, the charge in the capacitor C starts at the zero-cross times.

Starting from the zero-cross time $To$, the capacitor C is charged by the current flowing through the transistor $Tr_3$. Before the voltage $e_A$ across the capacitor C reaches the threshold voltage $e_B$, the triac $TRC_1$ is in an off state, so that no A.C. power is supplied to the heating element H. When the voltage $e_A$ reaches the threhold voltage $e_B$, corresponding with the time $t_1$ in FIG. 4, the PUT conducts to discharge the capacitor C, whereupon the pulse signal is generated in the pulse transformer PT. This pulse signal is then applied to the gate of the triac $TRC_1$ for causing the triac to conduct. The conducted state or onstate of the $TRC_1$ lasts until the A.C. power reaches the next zero-cross time $T_1$. Therefore, the A.C. power supplied to the heating element H is substantially equal to the shaded portion in FIG. 4. This operation is repeated in the subsequent cycles until the current for charging the capacitor C changes its value.

When the current for charging the capacitor C decreases, owing to an increase in temperature in the heating element H, the rate of charging the capacitor C decreases. Thus, the time for the voltage $e_A$ to reach the threshold voltage $e_B$ is prolonged. In this case, the pulse signal for causing the triac $TRC_1$ to conduct would be started at time $t_2$. This prolongation of the charging period would shift forward the starting phase of the A.C. power from $\theta_1$ to $\theta_2$ as shown in FIG. 4. On the other hand, contraction of the charging period, due an increase in the current for charging the capacitor C, would shift backward the starting phase of the A.C. power.

It should be noted that the pulse signal generated from the pulse transformer PT changes its phase between the minimum phase and the maximum phase. The minimum phase corresponds with the position when the phase $\theta_1$ is nearly zero and the maximum phase corresponds with the position when the phase $\theta_1$ is shifted a half cycle. In other words, the pulse signal having the minimum phase provides full power to the heater H and the pulse signal having the maximum phase provides no power to the heater H.

Accordingly, the temperature in the heater H is controlled to be maintained at the predetermined level fixed by the reference circuit 10.

When starting the copying operation of the electrophotographic copying apparatus, the arm $W_1$ of the switch SW is turned by a print switch (not shown) to the terminal $W_3$ for providing D.C. power from the source 22 to the driver circuit 24. Thus, the driver circuit 24 produces a suitable pulsating current therefrom to the gate of the triac $TRC_2$ for providing A.C. power to the exposure lamp P, so that the original to be copied is illuminated for forming the latent image on the photoreceptor (not shown).

In the meantime, the D.C. power from the power source 22 is also fed, through the variable resistor $VR_1$ of the regulator circuit 18 and the transistor $Tr_1$ to the comparator circuit 12, wherein a current flows through the transistor $Tr_3$. Although the amount of this current is restricted to less than the regulator level, i.e. the power required for adequate temperature regulation, illustrated at the time $T_5$ in FIG. 2(*a*) by the variable resistor $VR_1$ of the regulator circuit 18, the amount of such current is in relation to the voltage difference between the junctions $P_1$ and $P_2$. Therefore, the A.C. power supplied from the A.C. power source 5 to heater H is restricted to less than the regulator power, for example at most 30% of the full power from the A.C. power source.

After the operation of the exposure lamp is completed and before the copy material reaches the heating device (not shown), the switch SW is turned from the terminal $W_3$ to the terminal $W_2$, whereupon the current flowing through the transistor $Tr_1$ is increased, thus increasing the current flowing through the transistor $Tr_3$. The current flowing through the transistor $Tr_3$ charges the capacitor C to control the power to be supplied to the heating element H in the same manner as described above.

Since the capacitor C is charged at a higher rate than before, the fluctuation of the temperature in the heater H is recognized and response is more rapid than the period during the operation of the exposure lamp P. i.e., when the switch SW is turned to the terminal $W_3$. In other words, the heating element H consumes the electrical power at a higher rate while the copy material is fed to the heater device than the period during the operation of the exposure lamp P. However, such high power does not abruptly increase the temperature in the fixing device, but merely maintains the temperature at the optimum level for fixing the copy material. Therefore, the temperature in the fixing device does not fluctuate to a large extent during the fixing period.

It should be noted that the transistor $Tr_1$ described producing a constant current, may not necessarily be required to operate the power regulator of the present invention.

It should also be noted that the proportion of the power to be supplied to the heating element H during the operating period of the exposure lamp can be controlled by changing the value of the variable resistance $VR_1$.

According to the present invention, since the electrical power is provided to the heating element H during the operating period of the exposure lamp p, i.e., the exposing period, for controlling the temperature in the fixing device, the heating element H is warmed up in a condition ready for its operations. When the copy material reaches the fixing device, the predetermined temperature therein can be established in a moment without requiring unfavorablely high power, whereby the total power to be supplied to the electrophotographic copying apparatus is equilibrated throughout the complete operation.

Although the present invention has been fully described by way of example with reference to the attached drawings, it is to be noted that various changes and modifications are apparent to those skilled in the art. Therefore, unless such changes and modifications depart from the scope of the present invention, they should be construed as included therein.

What is claimed is:

1. An improved control means in an electrophotorgraphic copying apparatus having an exposing means provided with a lamp element for exposing an original to be copied, an operating means for operating said exposing means, a fixing means provided with a heating element for heating a copy material for fixing thereon a pattern of said original and a control means for controlling the electric power to be supplied to said fixing means in accordance with the variations of temperature in said fixing means, said control means comprising a power limiting means which limits said electric power to a predetermined level during the operation of said exposing means when said electric power to be supplied to said fixing means in accordance with said variations of said temperature in said fixing means is greater than said predetermined level.

2. An improved control means as claimed in claim 1, wherein said apparatus includes an AC power source for supplying AC power to said fixing means and said control means includes a detecting means for detecting said variations of said temperature in said fixing means, a power control means connected to said detecting means for supplying a variable portion of each half cycle of said AC power to said fixing means in accordance with said temperature detected by said detecting means.

3. An improved control means as claimed in claim 1, wherein said apparatus includes an AC power source for supplying AC power to said fixing means and said control means coupled a variable portion of each half cycle of said AC power to said fixing means in accordance with said variations of said temperature in said fixing means, said power limiting means limits said variable portion of each half cycle of said AC power supplied to said fixing means by said control means during said operation of said exposing means when said electric power to be supplied to said fixing means in accordance with said variation of said temperature in said fixing means is greater than said predetermined level.

4. An improved control means as claimed in claim 1, wherein said apparatus includes an AC power source for supplying AC power to said fixing means and said controlling means includes:

a detecting means for detecting said variation of said temperature in said fixing means;

a power control means connected with said detecting means for supplying a variable portion of each half cycle of said AC power to said fixing means in accordance with said variation of said detecting temperature detected by said detecting means; and said power limiting means for limiting said variable portion of each half cycle of said AC power controlled by said power control means during said operation of said exposing means when said electric power to be supplied to said fixing means controlled by said power control means is greater than a predetermined level.

5. An improved control means in an electrophotographic copying apparatus having means for illuminating an original to be copied, means for actuating said illuminating means, means for heating a copy material and means for controlling operations of said heating means in relation to variations of temperature in said heating means, wherein said apparatus includes AC power source for supplying AC power to said fixing means and said controlling means comprises:

a temperature detecting circuit for detecting said temperature in said heating means and for producing a temperature signal indicative of said detected temperature;

a reference circuit for producing a reference signal corresponding to a predetermined temperature in said heating means;

a comparator circuit for comparing said reference signal with said temperature signal and for producing a different signal indicative of the difference between said reference signal and said temperature signal;

a gate circuit connected to said comparator circuit for producing a control signal whose phase is shifted in relation to the phase of the AC electric power to be supplied to said heating means and the degree of said shift being in relation to said difference signal, said control signal supplied to said heating means so as to supply said heating means with said electric power upon receipt of said control signal; and a regulator circuit connected to said comparator circuit for limiting said difference signal produced by said comparator circuit during the operation of said illuminating means when said electric power to be supplied to said heating means in relation to said difference signal is greater than said predetermined level which indicates the maximum of said electric power to be supplied to said heating means during said operation of said illuminating means.

6. In an electrophotographic copying apparatus having exposing means provided with lamp element for exposing an original to be copied, operating means for operating said exposing means, fixing means provided with heating element for heating a copy material for fixing thereon a pattern of said original, and a power regulator operated by source of D.C. power for regulating A.C. power provided from a source of A.C. power to said exposing means and said fixing means, said power regulator comprising;

(a) first means for producing first signal upon receipt of D.C. power towards said exposing means for supplying part of the A.C. power from said A.C. power source to said exposing means;

(b) second means for producing second signal upon receipt of D.C. power towards said fixing means for supplying A.C. power from said A.C. power source to said fixing means;

(c) switch means for alternately providing said D.C. power to said first and second means; and (d) third means for providing said D.C. power towards said second means for supplying another part of A.C. power from said A.C. power source to said fixing means independently of the operation of said switching means, whereby said fixing means is actuated during the operation of said first means.

7. A power regulator as claimed in claim 6, wherein said second signal is variable with respect to temperature in said fixing means whereby said A.C. power supplied to said fixing means is varied in relation to change in said second signal so as to maintain the temperature in said fixing device approximately in a predetermined temperature.

8. A power regulator as claimed in claim 6, wherein said second means comprising;

(a) a temperature detecting circuit for detecting temperature in said fixing means and for producing temperature signal indicative of the detected temperature;

(b) a reference circuit for producing reference signal indicative of a predetermined temperature in said fixing means;

(c) a comparator circuit for comparing said reference signal with said temperature signal and for producing a diference signal indicative of a difference between said reference signal and said temperature signal; and (d) a gate circuit connected to said comparator circuit for producing a control signal whose phase is shifted in relation to the phase of said A.C. power and the degree of said shift being in relation to said difference signal, said control signal being applied to said fixing means whereby said fixing means is provided with said A.C. power upon receipt of said control signal.

9. A power regulator as claimed in claim 8, wherein said comparator circuit produces said difference signal only when the temperature signal is lower than tha reference signal.

10. A power regulator as claimed in claim 9, wherein said comparator circuit includes a capacitor for charging a current flowing through said comparator circuit, whereby said difference signal is a voltage signal produced across said capacitor.

11. A power regulator as claimed in claim 10 further comprising a threshold circuit connected to said gate circuit for producing a threshold voltage signal therefrom to said gate circuit, whereby said difference signal applied to said gate circuit passes, when the voltage of said difference signal reaches the threshold voltage signal, through said gate circuit for producing said control signal.

12. A power regulator as claimed in claim 11 further comprising a timing pulse producing circuit connected to said gate circuit for producing timing pulse signals indicative of zer-cross points after every half cycle in said A.C. power, so as to discharge the capacitor in said comparator circuit at every zero-cross points and to start charging the capacitor from every zero-cross points, whereby said control signal is produced within every half cycle, and with the phase thereof being shifted with respect to the phase of said timing pulse signal between two neighboring timing pulse signals.

13. A power regulator as claimed in claim 12, wherein said exposing means including a triac element which controls, upon receipt of said control signal, the amount of A.C. power between minimum and maximum by the degree of shifted phase in said control signal.

14. A power regulator as claimed in claim 8, wherein said first means comprising a drive circuit which produces a pulsating signal to said exposing means.

15. A power regulator as claimed in claim 14, wherein said exposing means including a triac element which controls, upon receipt of said pulsating signal, the amount of A.C. power between minimum and maximum by the degree of shifted phase in said pulsating signal.

16. A power regulator as claimed in claim 14, wherein said switching means is coupled to said D.C. power source for alternately providing D.C. power to said drive circuit and to said comparator circuit.

17. A power regulator as claimed in claim 8, wherein said third means including a variable resistor for regulating a current flow therethrough.

18. A power regulator as claimed in claim 17, wherein said variable resistor is connected between said D.C. power source and said comparator circuit.

* * * * *